US005594428A

United States Patent [19]

Peterson

[11] Patent Number: 5,594,428

[45] Date of Patent: Jan. 14, 1997

[54] COMBINATION SECURITY UNIT

[75] Inventor: John Peterson, Toronto, Canada

[73] Assignee: Digital Security Controls Ltd., Downsview, Canada

[21] Appl. No.: 325,670

[22] Filed: Oct. 19, 1994

Related U.S. Application Data

[63] Continuation-in-part of Ser. No. 279,157, Jul. 22, 1994.

[51] Int. Cl.[6] ..... G08B 5/22

[52] U.S. Cl. ..... 340/825.36; 340/531; 340/825.31; 340/825.32

[58] Field of Search ..... 340/825.36, 825.37, 340/825.31, 825.32, 825.44, 531, 541

[56] References Cited

U.S. PATENT DOCUMENTS 4,692,762 9/1987 Lewiner et al. ..... 340/825.31
4,723,121 2/1988 van den Boom et al. ..... 340/825.31
4,786,900 11/1988 Karaswa et al. ..... 340/825.31
4,908,604 3/1990 Jacob ..... 340/531
5,043,721 8/1991 May ..... 340/825.44

*Primary Examiner*—Brian Zimmerman
*Assistant Examiner*—Edward Merz

[57] ABSTRACT

A security system includes a small hand held remote unit which allows a user to communicate with an inside receiver/transceiver. The inside receiver/transceiver is battery powered and operates in a low power draw standby state until activated to a higher power draw state by receipt of an activation signal from the small hand held remote unit. Signals from the small hand held remote pass through a light transmitting medium forming part of the walls of the premise being protected. The inside receiver is positioned relative to the light transmitting medium to receive signals from the remote unit and produces a visible indication of the status of the system. This arrangement allows arming and disarming of the system from outside the area being protected.

10 Claims, 2 Drawing Sheets

COMBINATION SECURITY UNIT

CROSS-REFERENCE TO RELATED APPLICATIONS

This application is a continuation-in-part of Ser. No. 08/279,157, filed Jul. 22, 1994, pending.

BACKGROUND OF THE INVENTION

Security systems for homes, offices and apartments are now very common and these security systems typically include a control panel which receives and processes signals from sensors and communicates by telephone with a monitoring facility when an alarm condition occurs. Upon identification of an alarm condition, the monitoring authority typically contacts the fire or police, depending upon the nature of the alarm, and the proper authority investigates the situation.

For actual alarm conditions, this is the exact procedure that would be desired, however, in practice, most alarm conditions are due to user error, which is not confirmed until after the appropriate response by public authorities. This places unnecessary demands upon the fire and police and has resulted in certain restrictive procedures being adopted.

In particular, recurring false alarms (possibly as many as four false alarms in one year) may result in the police not investigating such an alarm condition, or certainly not investigating a reported alarm condition on an immediate basis. False alarms remain the most common problem for security systems and the monitoring companies and public servants who respond to such alarms.

The security industry is well aware of this problem, however, it is difficult to estimate the number of potential clients who would invest in a security alarm system, but are intimidated by the arming and disarming sequences of security systems and the possibility of user caused false alarms.

With security systems, there is typically a keypad closely adjacent one point of entry, for entering a code sequence. A user enters the premise at this point of entry and basically produces a delayed alarm condition. The security system allows the user a certain period of time to enter a proper code at the keypad to disarm the system and thereby nullify the alarm condition they created. This can be a stressful situation, particularly for people not familiar with the security system on a constant basis or for elderly users.

Another disadvantage of many security systems is the required time to install such systems. Even in the case of wireless alarm systems which, by definition, do not require hardwiring of the various components, the installation time can be considerable.

Some security systems have provided an exterior device which allows the system to be turned on or off. For example, a fixed position remote security control keypad can be provided. With systems of this type, the problem of the very short time period to correctly enter the security code at the keypad is avoided. However, protection of the fixed position keypad (e.g. from weather conditions and even possible sabotage due to its position) makes this solution not totally satisfactory. Also, the costs for exterior keypads is prohibitive.

Therefore, existing systems have certain operating deficiencies and are not "user friendly" with respect to the arming and disarming function. Furthermore, many such security systems do not have the capability of querying the system before entry to determine the status thereof, which may be highly desirable.

SUMMARY OF THE INVENTION

A security system according to the present invention has a plurality of sensors for sensing alarm conditions, a sounder for producing an audible alarm signal and a control panel which processes signals from the sensors and determines whether an alarm condition is present. In addition, the security system has an inside receiver/transceiver which can communicate with the control panel and which can recognize signals from a remote unit assigned to a user. The inside receiver/transceiver is battery powered and operates in a low power consumption standby state until activated by receipt of an activation signal from the remote unit and thereupon powers up to a full functioned state. The inside receiver/transceiver is positioned to communicate with the remote unit when located exterior of the premise through a light transmitting medium forming part of an exterior wall. The remote unit is capable of generating an activation signal and transmitting the activation signal through the transmitting medium to the inside receiver/transceiver. The inside receiver/transceiver in the standby state recognizes receipt of the activation signal and causes the inside receiver/transceiver to power up to the full function state. The remote unit cooperates with the inside receiver/transceiver for effecting disarming and arming of the security system using the remote unit and transmitting signals to the inside receiver/transceiver through the transparent medium.

According to an aspect of the invention, the inside receiver/transceiver, when the activation signal is received, produces an output signal which is transmitted through the transparent medium, and this output signal includes information as to the status of the security system. For example, whether the system is armed or disarmed.

According to an aspect of the invention, the activation signal produced by the remote unit is an infrared activation signal.

According to yet a further aspect of the invention, the inside receiver/transceiver carries out wireless communication with a remotely located control panel and wherein the inside receiver/transceiver, when activated to a full powered state, transmits a polling signal to the control panel and the control panel in response thereto transmits a system status signal to the inside receiver/transceiver. The inside receiver/transceiver, upon receipt of a system status signal, produces and transmits the output signal. To conserve power, the transceiver function for communicating with the control panel is shut down when the system status information is received. The inside receiver/transceiver therefore selectively uses the wireless communication with the control panel to conserve the battery power supply.

According to yet a further aspect of the invention, the transmitting medium is an optical barrel arrangement extending through an exterior wall or door. This optical barrel arrangement can be a peephole commonly used in doors.

According to a further aspect of the security system, the inside receiver/transceiver not only includes means for receiving the IR signal of the remote unit through a transparent medium in the exterior wall, it is also able to directly receive the signal from the remote unit from the interior of the premise being protected by the security system.

According to yet a further aspect of the invention, the inside unit is mounted on an exterior door.

According to yet a further preferred aspect of the invention, the exterior door includes a window which forms the transparent medium and the inside receiver/transceiver is mounted to receive IR signals from the remote unit, which passes through the window.

According to yet a further aspect of the invention, the inside receiver/transceiver is mounted on the inside of an exterior door, which includes a optical barrel arrangement passing through the door. The IR signal of the remote unit located exterior to the door passes through the optical barrel arrangement to the interior receiver secured on the door.

According to yet a further aspect of the invention, the inside receiver/transceiver includes at least one built-in sensor for determining if the exterior door is open.

BRIEF DESCRIPTION OF THE DRAWINGS

Preferred embodiments of the invention are shown in the drawings, wherein.

DETAILED DESCRIPTION OF THE PREFERRED EMBODIMENTS

Details of the invention can be best understood from a review of the drawings.

Figure 1:
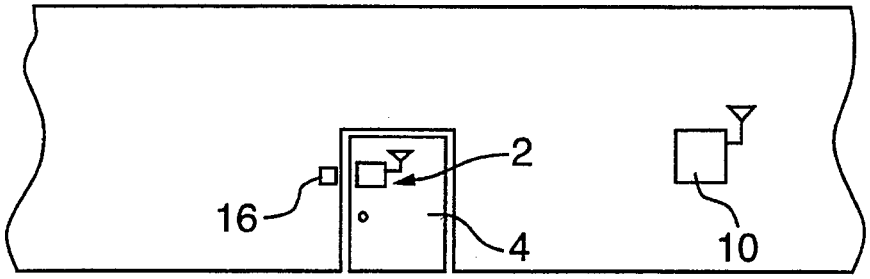
FIG. 1 is a schematic showing the inside receiver/transceiver mounted on an exterior door.
Figure 2:
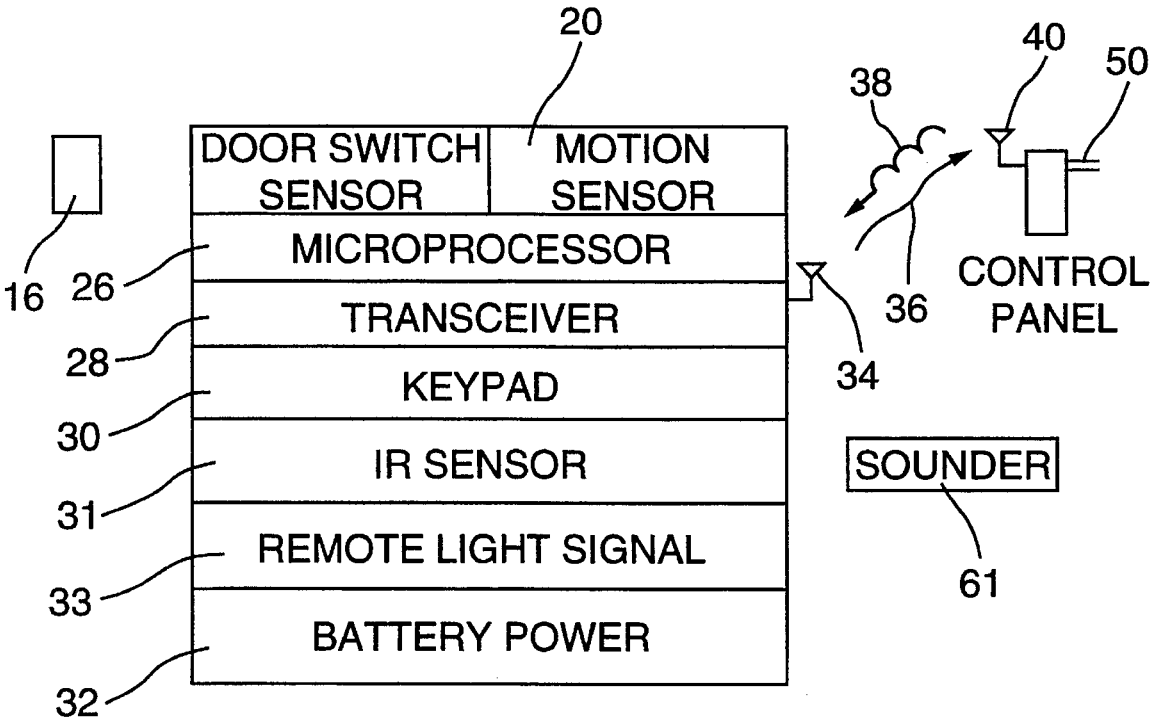
FIG. 2 is a schematic of an inside receiver/transceiver and the cooperation therewith with a control panel and sounder.
Figure 3:
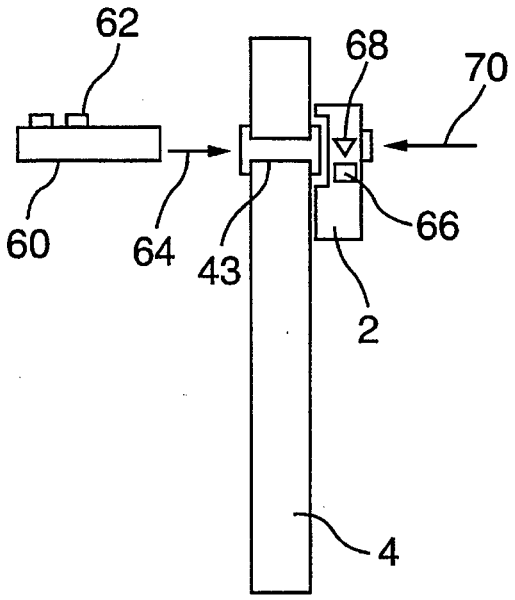
FIG. 3 is a sectional view through a door showing a barrel conduit which allows the signal of a remote control unit to pass through the door to an inside unit attached on the interior surface of the door.

In the preferred embodiment of the invention shown in FIGS. 1 and 2, an inside receiver/transceiver 2 cooperates with a control panel 10 and various wireless communications are transmitted therebetween. The inside receiver/transceiver 2 has a battery power supply 32 for powering a microprocessor 26. The microprocessor 26 is designed to operate in a low power standby state or in a full function state higher power draw state. The inside unit 2 also includes an IR (infrared) sensor 31 which detects an IR activation signal and causes the inside receiver/transceiver to switch from the standby state to the full function state. In the full function state, the receiver 2 selectively activates the transceiver 28 and communicates with control panel 10 in a wireless manner. The power draw of the transceiver is quite high and the useful life of the power supply would be very short if the transceiver was always powered. For this reason, the inside receiver/transceiver is activated by the user producing an activation signal causing the inside receiver/transceiver to change from the standby state to the full function state. In the full function state, the inside receiver/transceiver polls the control panel 10 to determine the status of the security system. A signal 36 is transmitted to the control panel requesting the status of the security system. This information is sent back to the inside receiver/transceiver via the signal 38. Once signal 38 is received, the transceiver is effectively shut down. The microprocessor 26 then relays the information to the exterior of the premise, as illustrated in FIG. 3, for example, through a light transmitting barrel 43 or perhaps through a window. The inside unit produces light signals 33 which are visible at the exterior of the door 4. A user at the exterior of the door then obtains information as to the status of the system and can also effect arming and disarming functions. A proper arming or disarming sequence will be communicated to the control panel.

The remote 60 includes a plurality of actuating buttons 62 which produces an infrared signal generally shown as 64. Signal 64 can be a coded signal, such that the inside unit 2 only enters the full function state when an appropriate authorization signal is received. Preferably the signal 64 is an infrared signal which allows for an infrared receiver, generally as 66, to receive the signal. The infrared receiver 66 receives the signal via a prism, shown as 68. This prism also allows an interior RF signal, shown as 70, to be received by the inside unit. These signals are processed by the infrared signal sensor 66. In this way, the remote 60 is effective both from the exterior and from the interior of the premises.

Returning to FIG. 2, it can be seen that the inside receiver/transceiver 2 includes a door switch sensor 16 and a motion sensor 20. These can be directly built into the unit, and therefore, can be directly connected to the microprocessor 26. Upon sensing of an alarm condition, the transceiver would be activated and the appropriate signal sent to the control panel 10. The control panel 10 can then effectively cooperate with the sounder 61 and a monitoring service, if desired.

The inside receiver/transceiver described in FIGS. 1, 2 and 3 has several advantages. The inside receiver/transceiver is easily mounted on an exterior door and can be mounted immediately adjacent a window in the door. The window forms a transparent medium through which a signal from the remote unit 60 can be received. In the case of a door without a suitable window, a small barrel arrangement 43 can be installed in the door with the inside unit secured to receive any signals which pass through the barrel arrangement. The barrel arrangement can be of the type now sold as a peephole for doors. The user can then use a user carried remote unit to transmit a signal, preferably an IR signal, through the transparent medium to the inside receiver/transceiver and cause it to switch from a standby state to a full function operational state. This type of communication, which basically wakes up the inside unit, greatly increases the battery life while still providing the user with immediate access to the system. The preferred IR signal from the remote is easily sensed with very little power draw. Other signals capable of being sensed by the inside receiver/transceiver in a low power or standby state can also be used.

The remote system 60 can include the programming of security codes by actuation of the switches 62 in a particular order, which produces a signal which is recognized by the inside unit 2. Failure to produce the correct signal results in the system staying in the inactive state. The microprocessor 26 can be programmed to keep track of the number of attempts in a given time period to gain access thereto and can shut down if a preset limit is exceeded, as this might indicate an attempt to breach the security system.

The inside receiver/transceiver and the microprocessor 26 can cooperate such that there is a two-stage process, namely a first coded signal which basically activates the inside receiver/transceiver and a second signal which would effect arming, disarming or other functions of the system. In this way, the breaking of a first code still requires the breaking of the second code, and thus, increases the level of security.

The inside receiver/transceiver, when operating in the full function state, effectively polls the control panel 10 and determines the system status. This information can be communicated (preferably visually) to the user through the transparent medium. The type of signal can be light emitting diodes, which could be red and green or yellow, to indicate armed, disarmed or an alarm condition has been reported, or any appropriate code, for example a single light could flash indicating that the system is armed or the light could remain steady if the system was disarmed. A quickly flashing pulse might be produced if the system had experienced an alarm condition. In this way, information is communicated to the user without gaining entry to the premise and without the alarm system producing a sensed condition that someone has entered the premise. The remote 60 also allows the user to activate or deactivate the system from the exterior of the premise, and thus, reduces the stress associated with the arming or disarming function.

The inside receiver/transceiver can be a combination device which also acts as a door sensor and motion sensor. This would be particularly valuable in apartments or offices where security around a single entry point may be sufficient. For example, in studios or bachelor apartments, the door is typically located in a position which provides a good view of the premises to be protected, and thus, a single combination unit may be sufficient. By combining the door sensor and motion sensor into the combination unit, the communication therebetween is obviously greatly reduced, as it is a direct connection completed at the time of manufacture. Furthermore, the concept of transmitting to a remote control panel can be eliminated and a sounder can be directly built into the unit, if desired. Obviously, there is some dilution of the level of security in such a combination unit, but it still would act as a deterrent and could be produced economically while having the many advantages possible by remote arming or disarming and system status information. A combination unit can still communicate with a remotely located control panel, if desired.

In another embodiment, the combination unit 4 can include glass break detection which can include a Piezo electric microphone. This type of microphone is used to monitor the frequency range typically from 3 to 4 kHz, which is a frequency band used in discriminating glass break signals from other signals. This Piezo electric microphone is also used to produce an alarm signal and acts as the sounder for the unit. Basically, the microphone structure can also act as the sounder and it merely has to operate in a different manner. The microprocessor can switch the Piezo electric microphone from its monitoring function to a sound producer. The monitoring function is, again, a low power requirement, and thus, makes it particularly suitable for this application. The dual purpose of this Piezo electric microphone has cost saving advantages with this system and other security systems.

The present system uses a remote unit which produces a signal which can be detected by the inside receiver/transceiver in a low power standby state. Upon detection of the signal, the inside receiver/transceiver assumes a full function state. The inside receiver/transceiver can then provide system information feedback to the user of the remote unit through a transparent medium immediately adjacent the inside receiver/transceiver. The remote unit can arm or disarm the alarm system from the exterior of the premises by transmitting certain signals through the transparent material. Preferably, the remote control unit is equally effective from the exterior of the building as well as the interior thereof, and thus, the inside receiver/transceiver is capable of receiving the signal from the remote either through an exterior wall having a transparent medium or directly from the remote when it is positioned closely adjacent the inside receiver/transceiver.

The inside receiver/transceiver can include a keypad 30 and function in the manner of a wireless keypads to allow the user to manually enter certain information.

The inside receiver/transceiver preferably is a transceiver which communicates with a remotely located control panel. This control panel typically includes phone communication capabilities 50 associated with a monitoring service.

Certain visible signals are produced by the inside receiver/transceiver when appropriately activated by the remote to provide feedback to the user of the status of the system. Furthermore, the remote can generate certain coded signals to effect disarming of the system or arming thereof. Typically, the inside unit has a transceiver which is only operative for very short transmissions, at which time it communicates with the control panel. In this way, the battery power of the inside unit allows for a substantial life, as the transceiver is basically off for most of the time. Upon receiving an appropriate signal from the remote, the inside unit communicates with the control panel and determines the status of the security system at a fixed point in time. It then uses this information and communicates that particular information to the remote unit. The transceiver is not always on in the full function state, but is available. The transceiver is also used to communicate information to the control panel when required, for example, if low battery occurs, periodic supervisory signals, an alarm condition sensed by any built-in sensors, or a tamper-indicating signal associated with the casing of the inside unit.

The invention also allows for a combination unit for easy installation in certain applications as discussed in the application. The remote is easy to use and reduces stress associated with arming or disarming of the system. For example, a user can arm the system after the user has mechanically locked the premise in the normal manner. The system thus reduces the probability of user generated false alarms associated with arming or disarming of the system, as this occurs with the user exterior to the premise. The remote unit is typically the size of a wireless control for locking and unlocking doors of a car and is therefore convenient to carry. Furthermore, each remote unit can have its own address and the control panel or inside unit can be programmed to recognize these signals in certain time periods.

Figure 4:
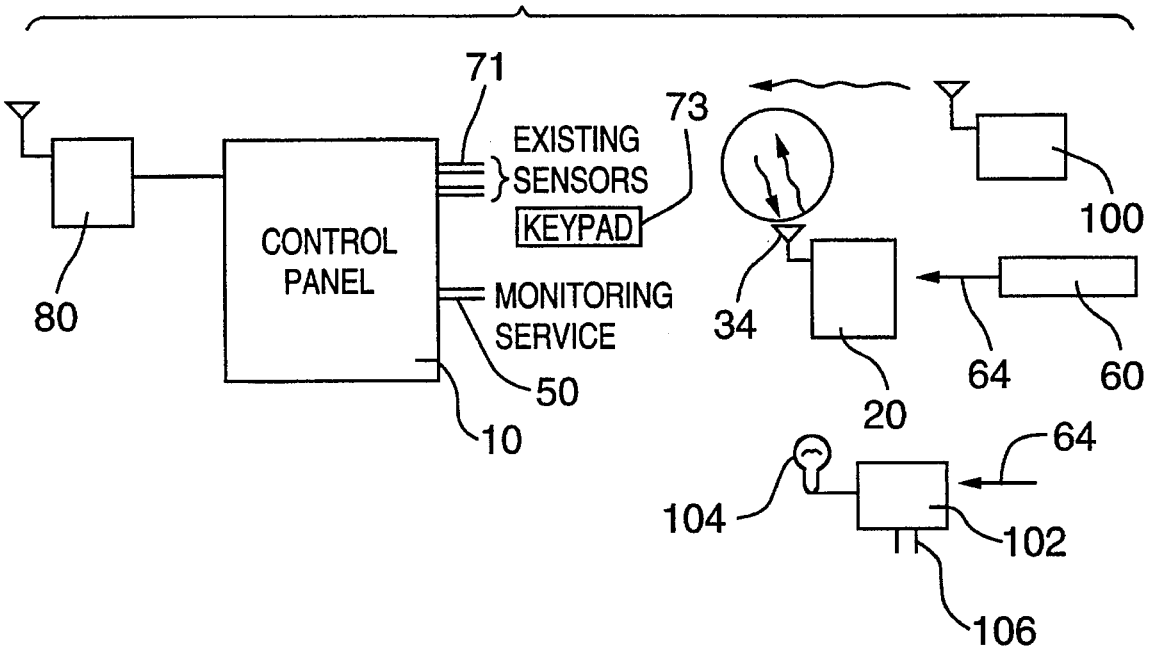
FIG. 4 is an alternate arrangement suitable for use with a hardwired security system.

FIG. 4 shows a hardwired security system having the control panel 10 directly wired to existing sensors and a keypad by wires 71. The control panel communicates with a monitoring service over telephone lines 50. An inside receiver/transceiver 2*a* is installed at the door adjacent the existing keypad and can send and receive signals via the wireless transceiver 34. The inside receiver/transceiver cooperates with a remote unit, as described in FIGS. 1 through 3. The control panel 10 is modified by adding the transceiver processing arrangement 80. In this way, the signals from the inside receiver/transceiver 2*a* are communicated to the control panel 10 and status or other signals are received by the inside receiver/transceiver 2*a* via the transceiver processing arrangement 80. Furthermore additional wireless sensors 100 for example a glass break detector can be added to the security system and communicate with the control panel via the transceiver processing arrangement 80.

The structure of FIG. 4 allows for a simple arrangement for retrofitting an existing system to allow remote units to be used. For example, if a user of a hardwired system generated a number of false alarms, the system could be retrofitted as shown in FIG. 4 and the user could arm or disarm the system using the remote unit 60.

The remote unit 60 can also be used to control other powered units, such as the wall receptacle 102. The wall has terminals 106 for insertion into a standard wall plug. In addition, the wall receptacle 102 includes an RF sensor for sensing directional signal 64 which originates from the remote unit 60. A traditional light 104 is connected to and controlled by the wall receptacle 102. The remote unit 102 generates a signal for turning the wall receptacle 102 on or off. This signal can be a unique lamp signal controlled by a special lamp button or could merely be the receipt of a general RF signal. The user can therefore use his remote to place the light 104 in its desired operating condition. This is very convenient upon entry or exit of the premises. From the above, it can be appreciated that the remote unit can additionally interact with additional power components of, or related to, the security system. The remote unit can control other power switching arrangements by sending signals to the control panel via the inside receiver/transceiver, if desired.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. In combination a security system and a premise defined by exterior walls with a light transmitting medium forming part of said exterior walls, said security system interior to said premise having a plurality of sensors for sensing alarm conditions, a sounder for producing an audible alarm signal, and a control panel which processes signals from said sensors and determines whether an alarm condition is present, and an inside receiver/transceiver; said security system also including a small hand held user remote unit for use exterior to said premise;

said inside receiver/transceiver being battery powered and operates in a low power draw standby state until activated by receipt of an activate signal from said remote unit and thereupon powers up to a full function higher power draw requirement state;

said inside receiver/transceiver being located to communicate with said user remote unit exterior to the premise through said light transmitting medium and communicates with said control panel to arm or disarm the system;

said remote unit selectively generating an activation signal and transmitting said activation through said light transmitting medium to said inside receiver/transceiver;

said inside receiver/transceiver in said standby state recognizing receipt of said activation signal and powering up to said higher power draw full function state;

said inside receiver/transceiver, when said activation signal is received, producing a visible indication of the status of said security system which is visible from the exterior of the premise through said transparent medium;

said remote unit cooperating with said inside receiver/transceiver for effecting arming and disarming of the security system by using said remote unit to transmit signals through said transparent medium to said inside receiver/transceiver and said inside receiver/transceiver producing visual indications of the status of the system.

2. In combination as claimed in claim 1 wherein said activation signal of said remote unit is an infrared activation signal.

3. In combination as claimed in claim 1 wherein said inside receiver/transceiver communicates in a wireless manner with said control panel, and wherein said inside receiver/transceiver, when activated to said full function state, transmits a polling signal to said control panel and receives a signal from the control panel indicating the status of the security system, said inside receiver/transceiver, upon receipt of said signal indicating the system status, produces said visual indication.

4. In combination as claimed in claim 2 wherein said transmitting medium is an optical barrel arrangement extending through one of said exterior walls.

5. In combination as claimed in claim 2 wherein said inside receiver/transceiver is mounted on an exterior door.

6. In combination as claimed in claim 5 wherein said exterior door includes a window which defines said transparent medium and said inside receiver/transceiver is mounted to receive IR signals from said remote unit which pass through said window.

7. In combination as claimed in claim 5 wherein said door includes an optical port through said door which forms said transparent medium, and said inside receiver/transceiver is mounted on said door to receive signals transmitted thereto through said optical port.

8. In combination as claimed in claim 7 wherein said inside receiver/transceiver includes a keypad by means of which a user can input instructions.

9. In combination as claimed in claim 5 wherein said inside receiver/transceiver includes a built-in sensor for determining if said exterior door is open.

10. In combination as claimed in claim 7 wherein said inside receiver/transceiver is mounted to cover said optical port and position said optical port and said receiver/transceiver in an aligned manner for receipt of signals from said user remote unit.

* * * * *